United States Patent [19]

Byrnes

[11] 4,250,595

[45] Feb. 17, 1981

[54] TOOL FOR OPENING AND CLOSING SKI BOOTS

[76] Inventor: Charles E. Byrnes, 118 E. 19th St., New York, N.Y. 10003

[21] Appl. No.: 34,945

[22] Filed: Apr. 30, 1979

[51] Int. Cl.[3] ..... A43C 11/00; A43D 5/00; B67B 7/00

[52] U.S. Cl. ..... 24/71.3; 12/103; 81/3.46 R

[58] Field of Search ..... 24/70 SK, 71.3, 69 SK; 81/3 R, 3.46 R, 3.46 A; 36/50, 1; 12/103; 29/270

[56] References Cited

U.S. PATENT DOCUMENTS

| | | | |
|---|---|---|---|
| 1,115,719 | 11/1914 | Mueller | 81/3 R |
| 2,948,058 | 8/1960 | Culkosky | 29/270 |
| 3,380,092 | 4/1968 | Golczynski | 12/103 |
| 3,902,226 | 9/1975 | Messenbaugh | 29/270 |
| 4,123,882 | 11/1978 | Case et al. | 81/3 R |

FOREIGN PATENT DOCUMENTS

| | | | |
|---|---|---|---|
| 177090 | 5/1953 | Austria | 12/103 |

*Primary Examiner*—Patrick D. Lawson
*Attorney, Agent, or Firm*—Charles E. Temko

[57] ABSTRACT

A hook-like tool for opening and closing the clamps on ski boots, overshoes and the like, providing leverage which is not otherwise obtainable when using the fingers. The device includes a handle member and an elongated member, the principal axis of which extends at a substantial angle relative to that of the handle member and is of a length corresponding to that of an engaged clasp.

1 Claim, 4 Drawing Figures

TOOL FOR OPENING AND CLOSING SKI BOOTS

BACKGROUND OF THE INVENTION

This invention relates generally to the field of manipulating tools, and more particularly to an improved hook-type tool adapted to the opening and closing of ski boots of a type in which one portion of the boot is provided with a plurality of wire loops selectively engaged and tightened by a corresponding number of clasps, the wire loops engaging a notch or recess on a second portion of the boot.

Clasps of this general nature have come into substantial prominence with the advent of boots which are molded from synthetic resinous materials as contrasted with earlier constructions which are formed of leather. In the molded boot, the usual eyelets and leather thongs are dispensed with, and there is provided a plurality of fasteners, each consisting of a wire loop attached to one side of a front opening in the boot and a pivotally mounted clasp member on an opposite side of the opening. While such clamps are simple to manufacture, and are reliable in operation, they are often difficult to manipulate, particularly when the fingers of the user are stiff from extended exposure to freezing temperatures. Not only is the problem present during a closing operation, but difficulty is often encountered during an opening operation as well.

SUMMARY OF THE INVENTION

Briefly stated, the invention contemplates the provision of an improved hook-type tool comprising an elongated handle member having a principal axis, and an elongated hook member, the principal axis of which extends at substantially a right angle with respect to the axis of the handle member, so that upon engagement with a clasp, the handle member may project outwardly from the surface of the boot to provide a convenient grip upon which substantial force may be applied. Where the tool is used for a closing operation, the hooked free end of the tool is engaged with a first end of the clasp adjacent the pivot axis thereof. Where an opening operation is to be performed, the position of the hook member is reversed to permit the application of similar leverage in an opposite pivotal direction.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
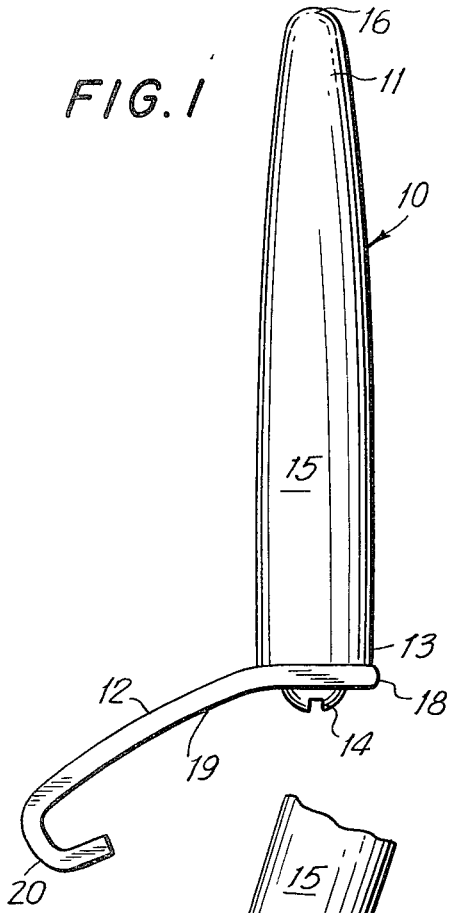
FIG. 1 is a side elevational view of an embodiment of the invention.

In accordance with the invention, the device, generally indicated by reference character 10, comprises broadly: a handle member 11 and a hook member 12.

The handle member 11 may be formed of wood, metal or synthetic resinous materials, and is provided at an inner end 13 thereof with a mounting screw 14. A cylindrical surface 15 leads to an outer end 16 which may be provided with an opening, whereby the same may be carried from a neckstrap, or a belt loop (not shown).

The hook member 12 is preferably formed as a metallic stamping from relatively heavy gauge stock, and includes a first end 18 secured by the screw 14 to the handle member 11. A slightly curved portion 19 extends from the end 18 and terminates in a hooked portion 20 having an arcuate extension of approximately 180° to terminate at a free end 21.

Figure 2:
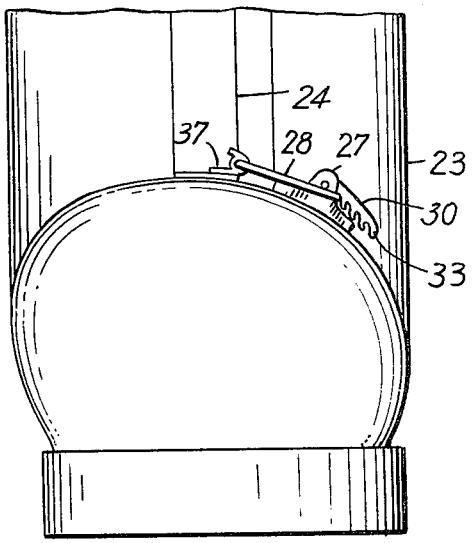
FIG. 2 is a front elevational view of a typical molded ski boot having closing clasps including wire loops engageable therewith.
Figure 3:
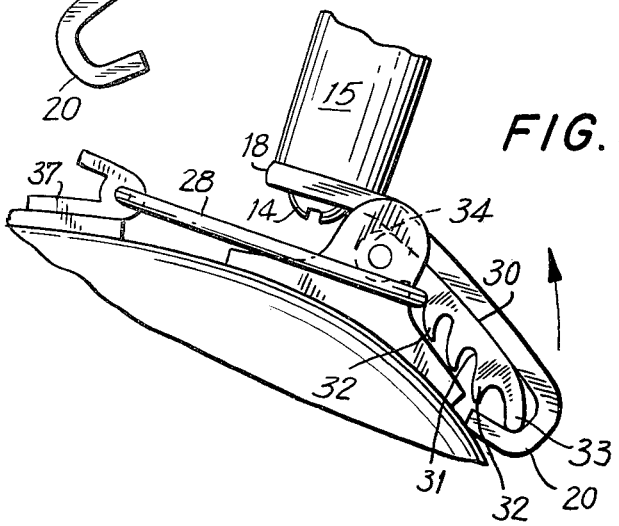
FIG. 3 is a fragmentary enlarged view in elevation, showing the embodiment in position prior to the start of an opening operation.
Figure 4:
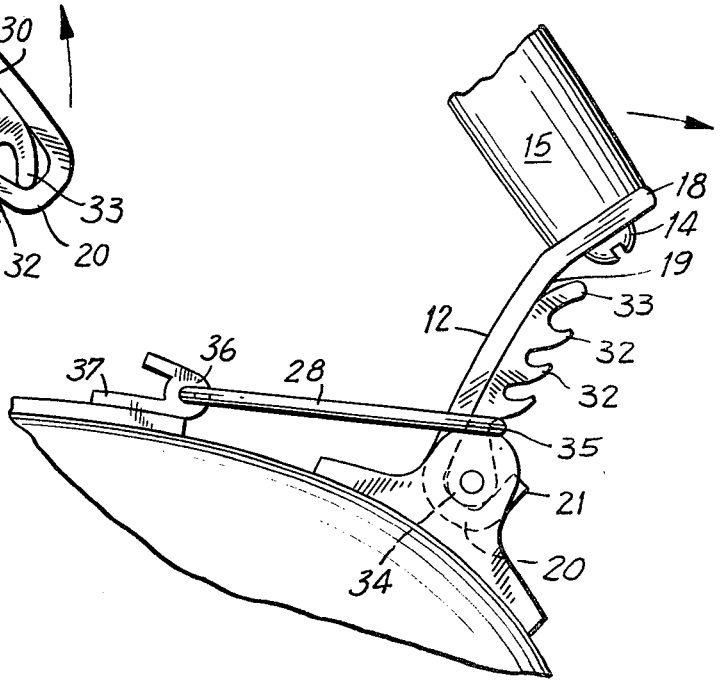
FIG. 4 is a similar fragmentary view in elevation, showing the embodiment in position prior to the commencement of a closing operation.

Referring to FIGS. 2 to 4, inclusive, there is illustrated a typical ski boot 23 of currently manufactured type, having a front opening 24 which extends downwardly to the vamp portion 26. This opening is closed by a plurality of clamp elements 27 which selectively engage pivotally mounted wire loops 28 on the other side of the opening. The specific details of this type of construction are well known, and are disclosed, for example, in the U.S. Pat. to Baso, No. 3,654,670; and the U.S. Pat. to Olivieri, No. 4,037,333; granted July 26, 1977. The clasps are most conveniently molded from synthetic resinous material, or die cast from metallic materials. They include an outer curved surface 30, an inner surface 31 having a plurality of loop-engaging members 32 extending between a free end 33 and a pivoted end 34. The wire loops 28 include a closed end 35, and open ends 36 which are pivotally secured to a bracket 37.

Referring to FIG. 4, the device 10 is shown in position prior to a closing operation. Before reaching this condition, it is necessary to first thread the clasp 27 through the opening in the loop 28, to afford access of the pivoted end 34 to the hook portion 20 of the device 10. The loop may then be positioned at the desired loop engaging member 32, depending upon the desired degree of tightness of the boot on the foot of the wearer (not shown). With the foot in place, the handle member 11 is then moved in the direction of the free end 33 of the clasp 27, the handle member 11 projecting directly outwardly from the surface of the boot to provide convenient manual access. Because the closing pressure is not applied by the fingers of the user, additional leverage is obtained by pressing on the handle member, which will normally quickly close the clasp against the outer surface of the boot. In many cases, this operation can be performed without the necessity of removing gloves or mittens.

Referring to FIG. 3, when it is desired to remove the boot, the position of the device 10 relative to the clasps is reversed, and the hook member 12 is inserted beneath the free end 33 of the clasps, following which the handle member 11 is moved in a direction opposite that used to close the clasps. Normally, the opening operation will be considerably easier, since the loops 28 have already been tensed.

I wish it to be understood that I do not consider the invention limited to the precise details of structure shown and set forth in this specification, for obvious modifications will occur to those skilled in the art to which the invention pertains.

I claim:

1. An improved tool for use in conjunction with a ski boot buckle assembly, said assembly including a clamping loop pivotally secured to a first portion of a ski boot, and an elongated tension lever having first and second end portions and top and bottom portions with said first end pivotally secured to a second portion of the ski boot, the clamping loop being insertable in one of a plurality of transverse grooves formed in the bottom portion of the tension lever, thereby to effect boot closure upon rotation of said tension lever away from said ski boot first portion, and open said boot upon rotation of said tension lever in an opposite direction, the improvement comprising: a handle member having a principal longitudinal axis and first and second ends, and an elongated hook member of generally planar configuration having a principal axis and first and second ends, said first end being attached to said first end of said handle member to form a right angle with the principal axis thereof, said hook member having a medially disposed portion of length which corresponds to that of the top portion of said lever, said second end of said hook member curving through substantially 180 degrees; said lever being selectively engageable with said first and second ends of said lever whereby said handle member may be manipulated laterally of said access thereof to open and close said boot.

* * * * *